United States Patent [19]

Albertsen

[11] Patent Number: 4,494,525

[45] Date of Patent: Jan. 22, 1985

[54] STOVE WITH CATALYTIC CONVERTER

[75] Inventor: Peter S. Albertsen, Corning, N.Y.

[73] Assignee: Corning Glass Works, Corning, N.Y.

[21] Appl. No.: 136,687

[22] Filed: Apr. 2, 1980

[51] Int. Cl.[3] ..... F23V 15/00; F23L 11/00

[52] U.S. Cl. ..... 126/289; 126/287; 126/193; 126/77; 110/203; 422/177

[58] Field of Search ..... 126/58, 80, 77, 287, 126/289, 193, 200, 63, 67; 110/203, 216; 422/174, 177, 200

[56] References Cited

U.S. PATENT DOCUMENTS

| | | | |
|---|---|---|---|
| 2,443,910 | 6/1948 | Higley | 126/287 |
| 2,845,882 | 8/1958 | Bratton | 110/203 X |
| 2,846,557 | 8/1958 | Schulze et al. | 422/174 |
| 3,043,245 | 7/1962 | Hebert et al. | 110/8 |
| 3,090,677 | 5/1963 | Scheitlin et al. | 422/174 |
| 3,611,954 | 10/1971 | Monroe, Jr. | 110/210 |
| 3,785,778 | 1/1974 | Burstein et al. | 422/174 |
| 4,121,560 | 10/1978 | Knight | 126/67 |
| 4,136,662 | 1/1979 | Willson | 126/77 |
| 4,180,052 | 12/1979 | Henderson | 126/123 |
| 4,192,285 | 3/1980 | Nietupski | 126/60 |
| 4,207,861 | 6/1980 | Buckner | 126/77 |
| 4,210,119 | 7/1980 | Kincaid | 126/200 |
| 4,249,509 | 2/1981 | Syme | 126/77 |
| 4,258,017 | 3/1981 | Gelfand | 110/203 |
| 4,279,629 | 7/1981 | Simms | 55/307 |
| 4,280,476 | 7/1981 | Webb | 126/287 |
| 4,330,503 | 5/1982 | Allaire et al. | 126/285 R |

*Primary Examiner*—James C. Yeung
*Attorney, Agent, or Firm*—R. N. Wardell

[57] ABSTRACT

This stove is divided by a partition into a lower, combustion chamber, and an upper chamber which communicates directly with an exhaust opening in the stove. A catalytic converter is removably mounted in an opening in the partition. A by-pass damper, which is connected to the stove door, is normally held closed over a by-pass opening in the wall of the lower chamber, when the door to the stove is closed, whereby all combustion gases from the lower chamber must pass upwardly through the converter and the secondary chamber to the exhaust opening. When the stove door is opened, the by-pass damper tilts by gravity into an open position so that combustion gases from the lower chamber pass directly to the exhaust opening rather through the upper chamber, and rather than being accidentally discharged out of the open door. The converter causes all by-products of combustion to be subjected to a secondary combustion in the converter before passing to the exhaust opening. A fan blows air under pressure into a space formed between the stove and a surrounding heat shield thereby to distribute more heat, and to prevent overheating of the walls of the stove. Primary combustion air is admitted by a damper to the bottom of the stove, and secondary air is admitted through an opening in the stove door around the edges of two glass panes which are mounted in the door.

3 Claims, 5 Drawing Figures

STOVE WITH CATALYTIC CONVERTER

This invention relates to wood-burning stoves and the like, and more particularly to novel means for improving complete combustion of the fuel which is burned in the stove. Even more particularly, this invention relates to a stove of the type described which is designed for use with a catalytic converter which removes substantial quantities of carbon and other undesirable by-products of combustion which would otherwise be discharged from the stove. The basic invention of using catalytic converters in wood-buring stoves is disclosed and claimed in the copending applicatiom Ser. No. 173,155 filed July 28, 1980, by R. V. Van Dewoestine, which is assigned to the assignee of this application.

With the advent of the present energy crunch, the use of old fashioned wood-burning stoves has been increasing rapidly. Frequently such stoves are added to supplement the modern central heating system of a home. One of the major problems encountered when using such a stove is its tendency to provide incomplete combustion of the fuel that is employed, thus producing large quantities of carbon and other undesirable by-products. These products of incomplete combustion tend not only to accumulate inside of the stove and to reduce its efficiency, but also tend to accumulate in the associated chimney or stack, thereby increasing the possibility of uncontrolled combustion taking place within the stack itself.

Numerous efforts have been made to modify stoves of this type to increase their efficiency; for example by improving the flow of air through the combustion chamber of the stove, thereby to increase the oxygen supply that is necessary for complete combustion. Frequently these efforts result in the use of special baffles within the combustion chamber, special dampers or vents for controlling air flow, and in certain models, electrically-operated blowers for introducing fresh air for combustion, and for distributing heated air from the stove to a room. None of these prior efforts, however, has resulted in a satisfactory solution to the problem of incomplete combustion.

Not infrequently, stoves of the type described also have windows in their front doors to increase the amount of heat that is radiated into a room from the stove, and also to permit observation of the combustion chamber. The by-products of incomplete combustion, however, usually tend to accumulate on the inside surfaces of these windows, and often to the point where they become translucent rather than transparent. This not only reduces the visibility of the stove's interior, but also tends to reduce the heat radiated from the windows.

It is an object of this invention, therefore, to provide an improved stove of the wood-burning variety, which is substantially more efficient than prior such stoves. To this end it is a specific object of this invention to employ a catalytic converter in the stove for effecting substantially complete combustion of fuel burned in the stove.

A further object of this invention is to provide for a stove of the type described a transparent sight glass for inspecting the catalytic converter in the stove.

Another object of this invention is to provide an improved wood-burning stove, which has primary and secondary combustion air supplies for effecting a more complete combustion of the fuel in the stove.

Still another object of this invention is to provide an improved wood-burning stove having self-cleaning glass windows in its front doors.

It is an object also of this invention to provide for a stove of the type described means for automatically preventing accidental discharge of combustion gases out of the front door of the stove, when the door is opened during a stove's operation.

A more specific object of this invention is to provide an improved wood-burning stove which has a catalytic converter mounted in its combustion chamber in such a manner that all combustion gases have to pass through the converter before being discharged to the stove's exhaust stack or chimney.

Other objects of this invention will be apparent hereinafter from the specification and from the recital of the appended claims, particularly when read in conjunction with the accompanying drawings.

Figure 1:
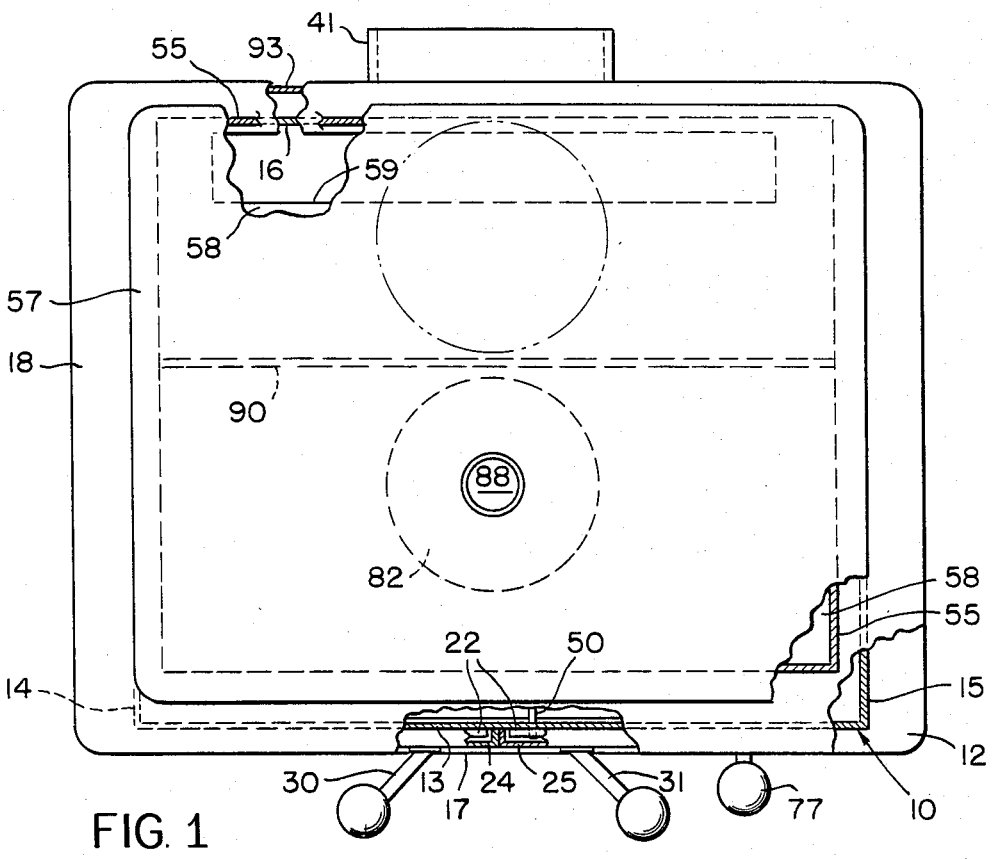
FIG. 1 is a plan view of a stove made according to one embodiment of this invention, portions of the stove being cut away and shown in section for purposes of illustration.

Referring now to the drawings by numerals of reference, 10 denotes generally a stove's fire box, comprising of a plane, vertical front wall 13, a pair of spaced, parallel side walls 14 and 15, which project at right angles rearwardly from the front wall 13, and a vertically disposed back wall 16, which extends transversely between the rear edges of the side walls 14 and 15, and parallel to the front wall 13. The rectangular firebox 10 is secured centrally on the upper surface of a plane, horizontally disposed bottom plate 17 and is closed at its upper end by a similar plate 18, which is secured adjacent its marginal edges on the fire box walls 13, 14, 15 and 16. The bottom plate 17 is supported adjacent each of its corners on the upper ends of four, similarly shaped metal feet or legs 19, which are designed to support the bottom 17 of the fire box horizontally on the floor of a room or the like.

Figure 2:
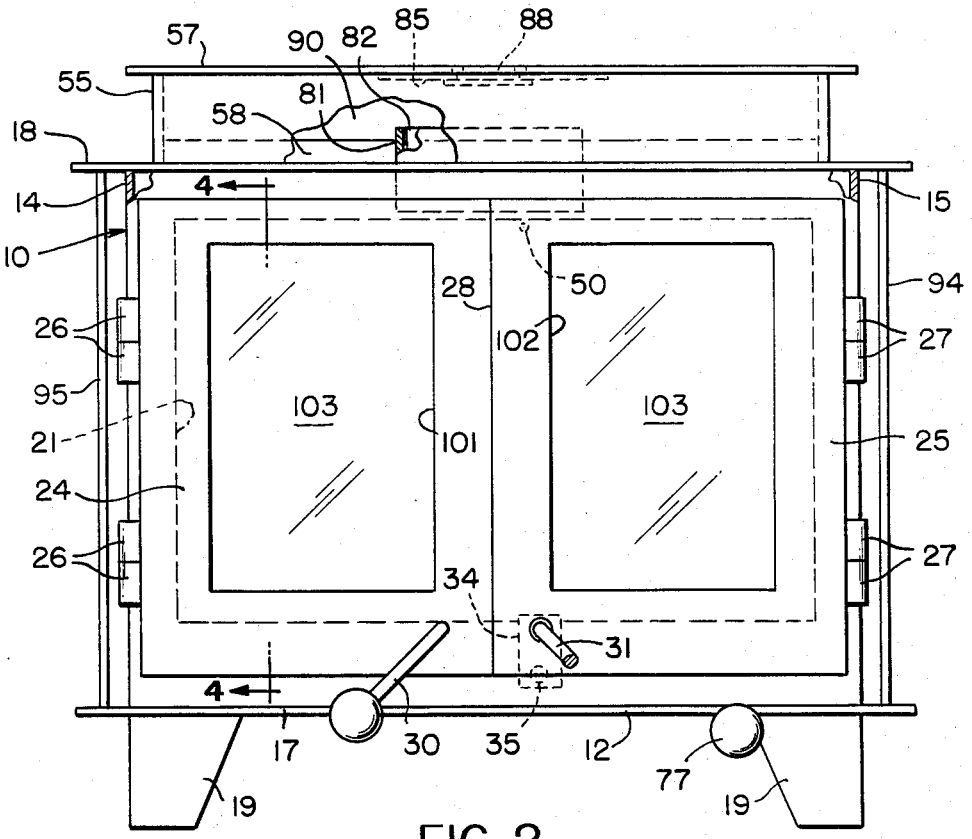
FIG. 2 is a front elevational view of this stove also with portions thereof cut away and shown in section for purposes of illustration.

The fire box 10 has in the center of its front wall 13 a large rectangular opening 21 (FIGS. 2 and 3), which is surrounded by a narrow flange 22 that projects laterally from the outer surface of wall 13. The opening 21 is adapted to be closed by two, rectangular, similarly-shaped doors 24 and 25, which are hingedly connected as at 26 and 27 to the left and right hand side edges, respectively, of the front wall 13 as shown in FIG. 2. These hinge connections 26 and 27, which are conventional and are therefore not described in detail herein, support the doors 24 and 25 so that the inner edges thereof meet and nearly engage along a vertical seam 28 (FIG. 2), when the doors are closed over the opening 21.

Doors 24 and 25 are manipulated by a pair of knobbed handles 30 and 31 ( FIGS. 1 and 2), the former of which is a dummy handle that is fixed at its inner end to the lower, right hand corner of door 24 as shown in FIG. 2. Handle 31 is rotatably journaled intermediate its ends in an opening 32 formed in the lower left hand corner of door 25 (FIG. 2) , and projects at its inner end into the fire box 10 when the doors 24 and 25 are closed. Secured at one end to the inner end of handle 31 to project radially therefrom is a small, rectangular plate 34. A screw 35 is adjustably threaded into the outer end of plate 34 (FIG. 3) so as to have its head disposed in closely spaced, confronting relation to the stationary fire box wall 13, when the doors 24 and 25 are latched closed as shown in the drawings.

When the plate 34 and adjustable screw 35 are swung by handle 31 into their latching positions (FIG. 3), plate 34 extends downwardly in front of a horizontal plate 38, that is positioned just above and parallel to the bottom plate 17 of the fire box to form part of a liner therefor. Plate 38 is fastened adjacent its forward edge to the front wall 13; and adjacent its rear edge it has thereon a downwardly projecting flange portion 39 (FIG. 3) which is supported on plate 17 just forwardly of wall 16. The fire box liner also includes a back plate or wall 41 (FIG. 3), which is secured along its lower edge to the rear edge of the liner plate 38, and the lower portion of which projects upwardly and parallel to the rear wall 16 of the fire box. Intermediate its ends plate 41 is bent slightly as at 42 so that its upper portion is inclined slightly to the vertical, and away from the rear wall 16 of the fire box. This inclined, upper portion of the liner plate 41 has therein a large, rectangular bypass opening 43 which registers with an exhaust opening 44 that is formed in the upper end of the rear fire box wall 16 for a purpose noted hereinafter.

Figure 3:
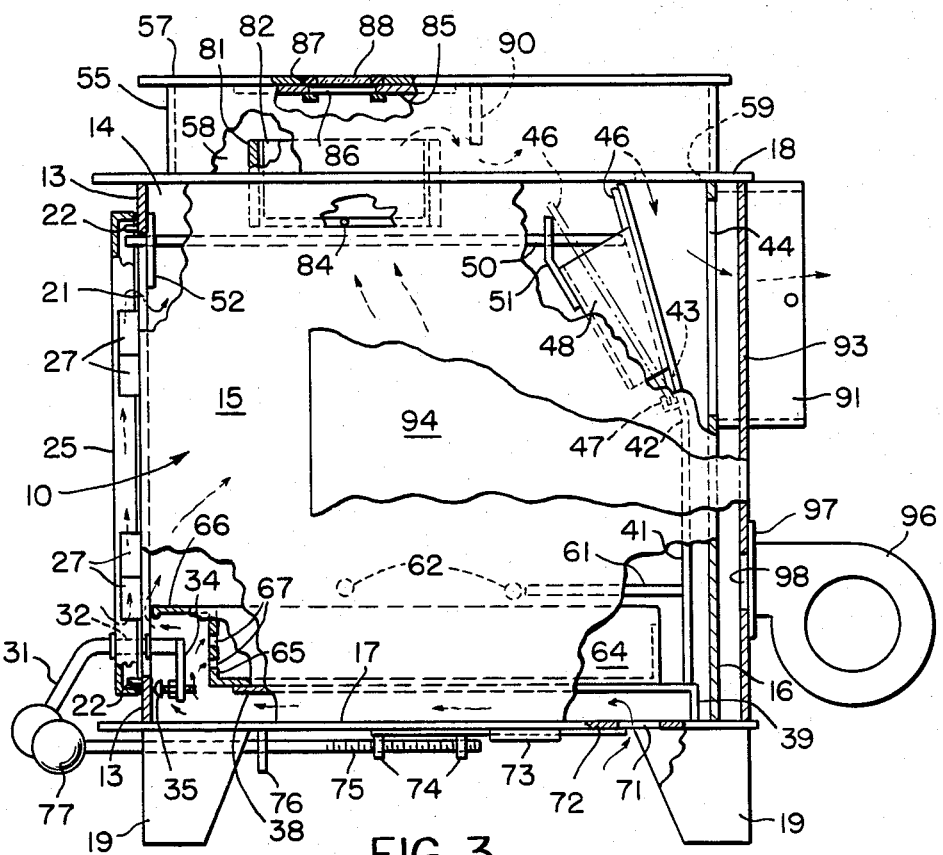
FIG. 3 is a side elevational view of this stove with portions again being cut away and shown in section.

Opening 43 is adapted to be closed by a large, rectangular damper plate 46, which has its lower edge mounted for pivotal movement in an angle bracket 47, that is secured to the inside surface of plate 41 adjacent to the lower edge of opening 43. Plate 46 is pivotal between the legs of a generally U-shaped bracket 48, the marginal side of which are fastened to the inside surface of the liner plate 41 adjacent opposite sides of opening 43. The back or inside surface of damper plate 46 rests upon the inner end of a push rod 50, which slides adjacent its inner end in an opening in a support plate 51, which is fastened to, and projects upwardly from, bracket 48. Adjacent its outer end rod 50 projects slidably through an opening in a stationary baffle 52 on the upper edge of wall 13, and into engagement with the inside of the door 25 when the latter is closed. With this construction, whenever the door 25 is swung to its open position, the weight of the inclined damper plate 46 urges the push rod 50 toward the left in FIG. 3 until the plate 46 is swung from its closed, full line position to its open or broken line position as shown in FIG. 3, wherein the upper edge of plate 46 comes to rest against the support plate 51. Obviously whenever the door 25 is closed, it reengages the push rod 50 and forces it and plate 46 back to their full line positions as shown in FIG. 3, thus once again closing the bypass opening 43.

Secured on top of the fire box cover plate 18 substantially centrally thereof is a rectangular housing 55, the upper end of which is sealed by a large, flat cover plate 57 which is similar in configuration to, but slightly smaller than, plate 18. The interior of housing 55 defines an exhaust chamber 58, which communicates through a large, rectangular opening 59 (FIG. 3), in plate 18 with the space formed in the upper end of the fire box between the bypass opening 43 and the exhaust opening 44 in wall 16.

Secured along one edge of the inside of the vertical portion of the liner plate 41, and projecting horizontally therefrom into the center of the fire box above and in spaced, parallel relation to the bottom plate 38 of the liner, is a rigid plate or shelf 61, which can be used to support thereon burning embers for banking a fire in the box 10 as noted hereinafter. Secured in opposite ends in the opposed side walls of the fire box, and extending transversely therebetween in a plane containing the shelf 61, is a plurality of spaced, parallel metal bars 62, which form supports for a conventional grate (not illustrated), which may be removably placed in a fire box 10 for holding kindling, fire wood, etc., in a known manner.

Removably mounted on the liner plate 38, and extending at its rear and beneath the support rods 62 and the shelf 61, is a relatively shallow, rectangular ash pan 64. The forward, vertically disposed wall 65 of the pan 64 is spaced horizontally from the front wall 13 of the fire box, and has thereon a forwardly projecting lip or flange 66 which overlies the door latching plate 34, and which provides a handle portion for moving the pan 64 into and out of the fire box through its front doors 24 and 25. When these doors are closed (FIG. 3), the forward edge of the flange 66 is spaced slightly rearwardly from the inside surfaces of the doors to allow air for combustion to enter the combustion chamber above pan 64 from the space between plates 17 and 38, as noted hereinafter. Air from this latter space is also permitted to enter the combustion chamber through a plurality of spaced openings 67 which are formed in the front wall 65 of the pan.

The primary source of air for supporting combustion in the fire box 10 is a rectangular opening 71 (FIG. 3), which is formed in the base plate 17 adjacent to its rear edge, and inwardly from the flange 39 on the liner plate 38. The quantity of air admitted through this opening is controlled by a damper plate 72, which is supported by a bracket 73 for sliding movement against the underside of plate 17. A pair of lugs 74, which project from the bottom of plate 72 adjacent to its forward end, are adjustably attached to the threaded end of a horizontal operating rod 75, which is slidably supported intermediate its ends by bracket a 76 which projects from the underside plate 17. A knob 77 on the outer end of rod 75 can be used manually to shift the damper 72 back and forth to cover or uncover the opening 71 to varying degrees, thereby to control the amount of primary combustion air that is admitted to the fire box.

Secured intermediate its ends in a circular opening, which is formed in the fire box cover plate 18 medially of its sides and slightly to the left ( FIG. 3), or forwardly of its centerline, is a steel ring or sleeve 81. Removably mounted in the bore sleeve 81 is a cylindrically-shaped catalytic converter element 82, which will be described in more detail hereinafter. The outside diameter of element 82 is slightly less than the inside diameter of sleeve 81 so that the element can be readily inserted into, and withdrawn from the bore of the sleeve. Element 82 is seated at its lower end on an elongate supporting pin 84, opposite ends which are removably seated in registering openings formed in the annular wall of sleeve 81 adjacent to its lower end, so that the pin 84 extends substantially diametrally across the center of the sleeve. As shown more clearly in FIG. 3, the sleeve 81 and the enclosed converter element extend at their upper ends part way into the exhaust chamber 58 in the housing 55, and at their lower ends extend into the upper end of the combustion chamber in the fire box 10.

Welded or otherwise secured to the inside surface of the exhaust chamber cover plate 57 to overlie the upper ends of sleeve 81 and its converter element 82 is a stainless steel plate 85. A circular opening 86 in the center of plate 85 registers coaxially with the sleeve 81 and element 82, and also with a circular opening 87 in the plate 57. A transparent, disc-shaped window or sight glass 88 is secured in the opening 87 to register with the center of the converter element 82, and to provide means for observing the element during operation of the stove.

When the damper plate 46 is in its closed position over the bypass opening 43 (FIG. 3), all combustion gases and the like rising from the interior of the fire box 10 must pass upwardly through the converter element 82 before entering the exhaust chamber 58. From there the gases pass beneath a plate baffle 90, which extends downwardly from the cover plate 57 and transversely between the side walls of housing 55 so to be positioned between the sleeve 81 and the exhaust opening 59. Consequently, after the gases have passed through element 82 and beneath baffle 90, they pass downwardly through the opening 59 to the opening 44 in the back 16 of the opening box. This opening communicates through an exhaust duct or flue 91 with the fire box chimney (not illustrated). As shown more clearly in FIG. 3, this duct 91 is secured at its inner end around the opening 44 in plate 16, and extends intermediate its ends through a registering opening formed in the back 93 of a generally U-shaped radiation shield, which surrounds the rear portion of the fire box 10 between plates 17 and 18.

This shield includes two, spaced, parallel side portions or arms 94 and 95, which project from section 93 forwardly to be disposed in spaced, parallel, overlapping relation to slightly more than the rear halves of the side walls 14 and 15 of the fire box. A conventional electric blower 96, which is mounted at the exterior of the radiation shield (FIG. 3), has its discharge end secured by a plate 97 over an opening 98, which is formed in the back portion 93 of the shield in communication with the narrow space which is formed between the shield and the rear portion of the fire box. When the stove is in operation, the shield 93, 94, 95 and the associated blower 96 perform the functions of preventing the fire box side walls 14 and 15 from overheating, thereby obviating the need to employ a fire brick lining in the fire box, and also serving to direct heated air from the space between the shield and the fire box out of the vertical openings formed between the forward edges of the shield and the fire box, when the stove and fan 96 are in use. Even when the fan is not in use the shield blocks direct radiation from the back and side walls of fire box 10 allowing the stove to be safely positioned closer to combustible walls.

Figure 4:
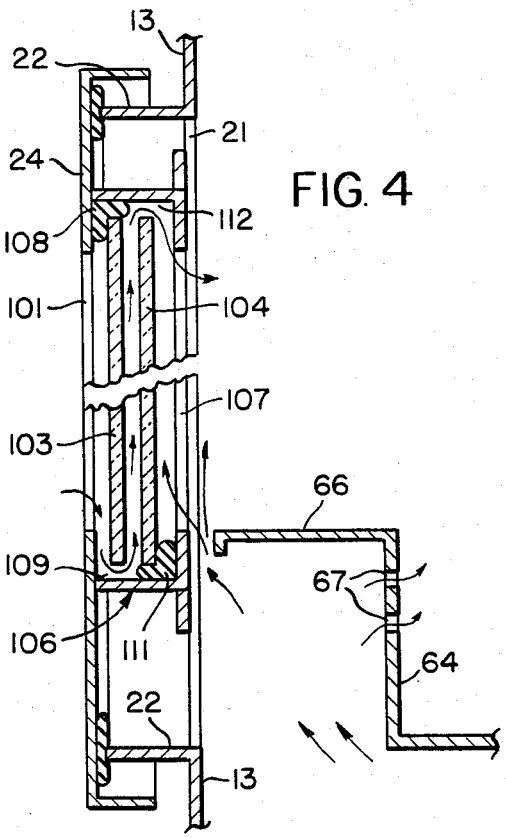
FIG. 4 is a slightly enlarged, fragmentary sectional view taken generally along the line 4—4 FIG. 2 looking in the direction of the arrows, and illustrating one manner in which dual glass windows can be mounted in the front doors of the stove.

As shown more clearly in FIGS. 2 and 4, the doors 24 and 25 have therein large, central, rectangular openings 101 and 102 respectively. Each of the openings 101 and 102 is closed by a pair of spaced, parallel, vertically disposed panes 103 and 104 of medium and high temperature glass, respectively. Two of these panes are shown by way of example in FIG. 4. Since the manner in which the way the two panes are mounted in each door 24 and 25 is similar, only the construction of door 24 will be described in detail herein.

Referring now to FIG. 4, 106 denotes generally a rectangular frame which is fastened to the inside of the door 24 around its opening 101. This frame also has therethrough a rectangular opening 107 which registers with, and is similar in configuration to, the opening 101 in the door. The panes 103 and 104 are secured in frame 106 to extend transversely between the openings 101 and 107 in spaced, parallel relation to each other. The outer pane 103 is sealingly secured by conventional gasket material along three of its edges, namely its upper edge (as at 108) and along its two side edges, against the inside of door 24 around its opening 101. Deliberately, however, the gasket material is not incorporated between the lower edge of pane 103 and the confronting surface of the frame 106, whereby an elongate, narrow opening or gap 109 is formed between the frame of 106 and the lower edge of pane 103. Pane 104, on the other hand, has its two vertical side edges and its lower edge secured, as at 111, by gasket material against the inside surface of the frame 106 around its opening 107, so that its upper edge is spaced as at 112 slightly beneath the confronting surface of frame 106.

As a result of the manner in which panes 103 and 104 are mounted in each door 24 and 25, when the stove is in operation a secondary supply of air for combustion enters the interior of the fire box through its doors 24 and 25 by passing through the gap 109 along the bottom of the outer pane 103, as indicated by the arrows in FIG. 4, then upwardly between the panes 103 and 104, and then through the gap 112 and out of the opening 107 in frame 106 to the combustion chamber adjacent its upper end. Assuming that the stove is in operation, primary air will also be entering the interior of the fire box at this time from beneath the liner plate 38, passing upwardly as shown by the arrows in FIG. 3 between the lip 66 on the ash pan 64 and into the combustion chamber. Also as indicated by the arrows in this figure, a portion of this primary air is free to pass to the interior of the fire box through the openings 67 in the front wall of pan 64.

The inner pane operates at a higher temperature due to reflected radiation from the outer pane. The higher temperature reduces condensation. The secondary air flow draws any flow of smoke away from the upper portion of the window. As a result of the design of the pane mountings in the doors 24 and 25, and also because of the manner in which the primary air is fed into the fire box over the forward edge 66 of the ash pan, the windows or panes 103 and 104 are, in essence, self-cleaning. For example, with incoming secondary air entering the fire box along the upper edges of doors 24 and 25, and with the primary combustion-supporting air being directed by the ash pan lip 66 vertically upwardly along the inside of the window panes 104, accumulation of ash and other foreign matter on the panes 103 and 104 is minimized. Moreover, with the secondary air entering the upper end of the combustion chamber, it supplies the necessary oxygen for supporting complete combustion of gaseous fuels in the catalytic convertor which might otherwise be only partially burned because of an inadequate supply of oxygen from the primary air supply from the bottom of the fire box.

Figure 5:
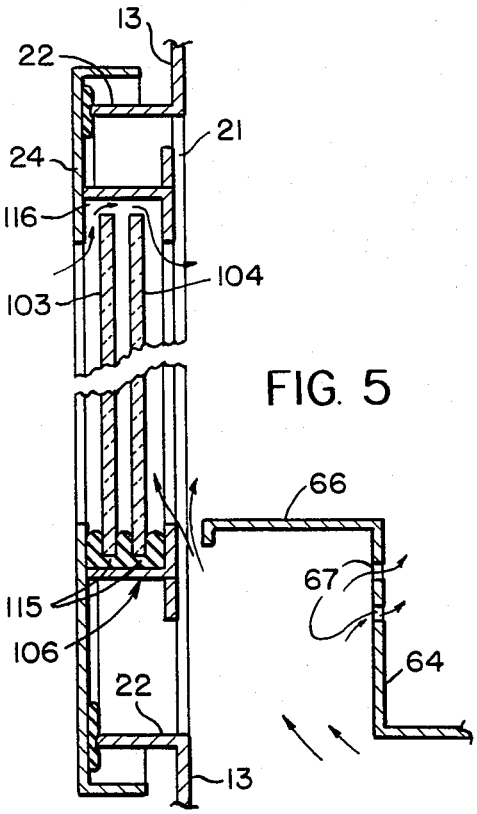
FIG. 5 is a view similar to FIG. 4 and illustrating still another manner in which dual windows can be mounted in the stove doors.

FIG. 5, which is similar to FIG. 4, illustrates a modified manner of mounting the two panes 103 and 104 in doors 24 and 25 to permit a secondary supply of air therethrough. In this modified embodiment each of the panes 103 and 104 has its vertical side edges and its lower edge secured by gasket material as in 115 against the inside frame 106, thereby forming a gap 116 in the frame 106 over the upper edges of the two panes 103 and 104 in each door so that the secondary air supply enters through the doors 24 and 25 over the upper edges of the panes. Also as in the preceding embodiment, the primary air still enters the fire box over the forward edge of the lip 66 on the ash pan 64, so that the incoming primary air tends to wash or clean the inside surfaces to the inner panes 104.

In use, handle 31 may be manipulated by rotating it counterclockwise from its position as shown in FIG. 2, thereby swinging its latching screw 35 out of registry with the bottom of wall 13, and thus permitting both doors 24 and 25 to be swung open about their respective hinges 26 and 27. A conventional grate (not illustrated) can then be placed on top of supporting rods 62, together with a supply of fuel (for example wood). The damper 72 is then opened at least partially; and assuming that the converter element 82 is already in the holder 81, the fire can be started and the doors 24 and 25 once again may be closed. As previously noted, whenever door 25 is open, the damper plate 46 swings downwardly to its broken line position in FIG. 3, thereby opening the bypass 43 so that any flame or gases in the fire box will be drawn rearwardly and outwardly through the openings 43 and 44 and the exhaust duct 91 to the associated chimney (not illustrated). This prevents any undesirable rush of flame and/or gas out of the front of the fire box, when its doors are opened during its operation.

After the fire has been started and the fire box doors have been closed, door 25 strikes the rod 50 which pushes the damper plate 46 closed over the bypass opening 43, so all carbon and gases generated in the combustion chamber will thereafter have to pass upwardly through the converter element 82 before entering the exhaust chamber 58. Especially in the spring and the fall, when the heating requirements of a stove of the type described are not as high, the combustion air fed to the fire box is usually quite restricted. At this point much of the combustion in the fire box is accompanied by pyrolysis, which is an incomplete combustion of fuel resulting from oxidizing without sufficient air. As a result, smoke is produced because the hot combustible gases, tars, and carbon particles are not mixing well enough with available oxygen, and the temperature in the combustion chamber of the fire box is not high enough, under this type of operation, to effect complete combustion.

However, it has been found that when a converter 82 of the type disclosed herein is employed, additional and more complete combustion occurs in and around the converter itself. This element, which has a porous, cellular structure is formed with the plurality of axially extending cells or ducts through which gases and particles must pass in order to migrate from the combustion chamber in the fire box 10 to the exhaust chamber 58, which can also be regarded, at least in part, as a secondary combustion chamber, since combustion actually occurs within the cellular structure of the converter element 82 during its operation. The converter 82 in this embodiment comprises a ceramic matrix having deposited thereon a thin coating of an exotic metal, such as paladium, platinum, or the like. It has a very fine cell structure, for example on the order of twenty cells per square inch, and may be approximately 5¾" in diameter and 3" in length. In a cross section element 82 has the appearance of a plurality of cells or rectangular ducts, the walls of which are arranged in intersecting rows and columns. Cells of this type are currently available on the market, and their exact construction and configuration form no part of this invention. Similar such converters have been employed in self-cleaning ovens, and are capable of functioning at extremely high temperatures, for example in the range of from 500° F. to 2600° F.

When products of incomplete combustion pass axially into and through the converter element 82, it has been found that they are subjected to an intensely hot combustion process both in and around the upper end of the element, and to such an extent that the element itself becomes extremely hot as compared to the intensity of the heat within the fire box. The effectiveness of the converter element 82 can be monitored by observing its color through the sight glass 88. When the element is working properly, it tends to glow bright red or qrange in color, indicating that secondary combustion is taking place in and around the element, thereby completely burning up combustible gases, tars and carbon particles which might otherwise be discharged as undesirable emissions to the associated stack or chimney. The relative position of the sight glass with respect to the catalytic converter is such that the catalytic converter, when operative, will clean the glass of any deposits through high intensity radiant heat.

From the foregoing it will be apparent that the present invention provides a relatively simple and inexpensive means for effecting substantially complete and thorough combustion of all combustible by-products of the fuel which is burned in the main combustion chamber of applicant's novel stove. By supplying combustion air from two different sources, (i.e., both from the bottom and from the top of the fire box) it is possible better to maintain the quantity of oxygen necessary to support combustion both in the main combustion chamber of the fire box, and in the vicinity of the converter element 82. Moreover, by utilizing the converter in the manner taught herein, it is possible to reduce to a negligible amount, the undesirable emissions which normally accompany the use of conventional stoves with converters. It is well known, for example, that except under high fire conditions and accompanying high temperatures, wood-burning stoves typically produce large quanitities of carbon monoxide and other combustible hydrocarbons, which eventually condense on the lining of the associated chimney, thereby forming objectionable creosote deposits which result in an undesirable fire hazard in the chimney itself. By utilizing a catalytic converter to assure complete combustion of all products leaving the combustion chamber of the fire box, these objectionable by-products and consequent dangers are minimized.

Still another advantage of the applicant's novel stove is that from the use of the blower 96 requires no sophisticated electrical controls. In addition, the blower 96 and associated heat shield 93, 94, 95 not only prolong the life of the stove, but also provide an efficient manner of distributing more heat to the associated room. Furthermore, the automatically operating damper control rod 50 provides a simple means for eliminating any undesirable flashback or discharge of flame and and gas out of the front of the stove whenever its doors 24 and 25 are open. Also, the shelf 61 adjacent to the rear of the fire box liner allows burning embers to be stacked thereon when it is desired to bank the fire in the stove.

When hot coals are accumulated on the shelf it has been found that they often will last overnight, and will still be smoldering or burning the next day, thereby simplfying the restarting of the stove.

While this invention has been described in connection with the use of the fire wood, it will be apparent that it can be used to burn any type of bio-mass fuels, including coal provided the usual cautions are taken to prevent the escape of noxious fumes. Moreover, although the stove has been described in connection with its operation using the converter element 82, it likewise could be used without the element, although perhaps not as efficiently. Also, although only certain embodiments have been illustrated in detail herein, it will be apparent that the invention is capable of still further modification, and that this application is intended to cover any such modifications as may fall within scope of one skilled in the art or the appended claims.

What I claim is:

1. A stove comprising a fire box having therein a combustion chamber, a door on said box movable between open and closed positions relative to a first opening in said box, means for admitting air for combustion to said chamber, including a second opening in said box adjacent the bottom thereof, said box having therein two further openings for exhausting combustion gases from said chamber to the exterior of said box, a catalytic converter mounted in one of said two further openings which is located in the top of the firebox, said converter comprising a cellular structure having a plurality of closely-spaced cells or ducts extending axially therethrough and appearing in cross-section with walls of the cells or ducts arranged in intersecting rows and columns, means for selectively closing the other of said two further openings, said converter being positioned so that, when said other opening is closed, all said gases from said combustion chamber are caused to pass through said converter, said door has two panes of glass secured across an opening in said door in spaced, parallel relation, at least a portion of the peripheral edge of each of said panes is spaced from a portion of the periphery of the opening in said door, thereby to admit additional air to said chamber through said opening in the door, and said portions of said edges of said panes are located adjacent opposite edges of the opening in said door, whereby said additional air passes through the space between said panes during passage thereof into said combustion chamber.

2. A stove comprising a fire box having front, rear, top, bottom and side walls, said walls defining therein a combustion chamber, a door on said box movable between open and closed positions relative to a first opening in said box, means for admitting air for combustion to said chamber, including a second opening in said box adjacent the bottom wall thereof, said box having therein two further openings for exhausting combustion gases from said chamber to the exterior of said box.

a catalytic converter mounted in one of said two further openings which is located in the top wall of the firebox, said converter comprising a cellular structure having a plurality of closely-spaced cells or ducts extending axially therethrough and appearing in cross-section with walls of the cells or ducts arranged in intersecting rows and columns, means for selectively closing the other of said two further openings, said converter being positioned so that, when said other of said two openings is closed, all said gases from said combustion chamber are caused to pass through said converter, said door is mounted on the front wall of said fire box, and said other of said two openings is formed in an inclined portion of the rear wall of said fire box, a plate projects horizontally from the rear wall of said fire box adjacent the lower edge thereof, and part way into said combustion chamber in spaced, parallel relation to the bottom wall of said fire box, and an ash pan is removably mounted on the bottom wall of said fire box in said combustion chamber and projects adjacent its inner end beneath said plate.

3. A stove for burning bio-mass fuel, comprising a housing having therein at least one chamber for burning said fuel and an exhaust opening connecting said one chamber to the exterior of said housing, door means movably mounted over an access opening in said housing to permit the insertion of said fuel into, and the withdrawal of ashes from, said one chamber, an air inlet means in said housing for admitting air to said one chamber, when said door means is closed, to support combustion therein, and a pair of transparent panes mounted across a central opening in said door means in spaced, parallel relation to each other, an upper edge of the inner one of said panes being spaced from an upper portion of the periphery of said central oening and a lower edge of the outer one of said panes being spaced from a lower portion of said periphery, whereby additional air passes through the space between said panes and enters said one chamber through said door means.

* * * * *